US005147992A

United States Patent [19]

Eriksen et al.

[11] Patent Number: 5,147,992

[45] Date of Patent: Sep. 15, 1992

[54] JACK ASSEMBLY

[75] Inventors: Byron Eriksen, Minneapolis; Bruce Ogren, Edina, both of Minn.

[73] Assignee: ADC Telecommunications, Inc., Minneapolis, Minn.

[21] Appl. No.: 708,083

[22] Filed: May 24, 1991

Related U.S. Application Data

[63] Continuation-in-part of Ser. No. 536,966, Jun. 12, 1990, abandoned.

[51] Int. Cl.[5] ..... H01R 33/96

[52] U.S. Cl. ..... 200/51.1; 200/275; 439/188

[58] Field of Search ..... 200/51.1, 275, 504, 200/510, 51.03; 439/578, 675, 620, 188

[56] References Cited

U.S. PATENT DOCUMENTS 4,749,968 6/1988 Burroughs ..... 200/504 X 4,792,307 12/1988 Stewart, Sr. ..... 439/74.1 X

*Primary Examiner*—Larry I. Schwartz
*Assistant Examiner*—J. R. Daulton
*Attorney, Agent, or Firm*—Merchant, Gould, Smith, Edell, Welter & Schmidt

[57] ABSTRACT

A switching coax jack is disclosed having a housing which contains first and second spaced apart electrical conductors. At least a first port is formed in the jack housing and sized to receive a jack plug which is inserted through the port into the housing with a jack plug in electrical communication with the first conductor. A switch assembly contains a normal spring for connecting the first and second conductors. The spring is resiliently deformable away from electrical engagement with the first and second conductors. As the spring deforms, it assumes a deformed shape. The switch assembly includes a support surface opposing the normal spring and having a shape complimentary to the deformed shape of the normal spring.

11 Claims, 8 Drawing Sheets

JACK ASSEMBLY

This is a continuation-in-part of application Ser. No. 07/536,966, filed Jun. 12, 1990 now abandoned.

I. BACKGROUND OF THE INVENTION

1. Field of the Invention

This invention pertains to a jack assembly for use in the telecommunications or signal transmission industries. More particularly, this invention pertains to an improved switch assembly for such a jack.

2. Description of the Prior Art

Switching coax jack assemblies for use in the telecommunications or signal transmission industries are well known. An example of such is shown in commonly assigned U.S. Pat. No. 4,749,968 to Burroughs dated Jun. 7, 1988. The Burroughs patent teaches a switching coax jack having a housing which contains two parallel spaced apart internal conductors. Ports on the forward end of the jack permit a plug to be inserted within the jack housing to make electrical contact with the conductors. The Burroughs patent teaches two configurations where the forward end of the jack has either one or two forward ports.

In Burroughs, a switch assembly is provided for normally connecting the internal conductors but breaking the electrical connection upon insertion of a jack plug into either of the forward ports. With best reference to FIG. 11 of U.S. Pat. No. 4,749,968, the jack includes a switch assembly 156 having a normal spring 164 in a generally V-shaped configuration extending between the conductors 150,158. Upon insertion, a jack plug 52 engages a termination spring 168 which deflects to urge a first portion of a normal spring 164 away from conductor 150.

In switch designs, a risk of failure is presented by cyclic deformation of the normal spring by repeated insertion of a jack plug into the jack assembly. Namely, the deformation of the normal spring may result in breakage or plastic deformation of the normal spring.

The consequences of failure of the normal spring can best be appreciated by consideration of the environment in which a jack assembly is used. The jack assembly is one of several assemblies and other elements combined in a module (referred to as a "DSX module"). Examples of such modules are shown in U.S. Pat. No. 4,815,104 (FIGS. 1–6). In the event of failure of a normal spring in a jack assembly, the entire module must be replaced. This has severe economic consequences. The spring which fails is typically inexpensive (for example, less than $1.00 U.S.). On the other hand, the module which must be replaced upon failure of this spring can be quite expensive (typically greater than $200.00 U.S.).

Even more significant than the adverse economic consequences resulting from spring failure is the interruption in data or signal transmission resulting from such failure. Modules incorporating switching coax jacks are commonly used in the telecommunications industry for cross-connecting voice or data transmission lines. At high signal speed transmission rates (known in the industry as DS-3 rates or greater), a single DSX module may handle 672 voice conversations simultaneously. If a single normal spring fails within the DSX module, the module fails and the many customers being serviced by the module have their service interrupted.

Due to the significant economic and service interruption consequences attributable to spring failure, the telecommunications industry has prudently placed a high premium on reliability of spring contacts used in switching coax jacks. Accordingly, while designs such as that shown in the Burroughs patent are commercially satisfactory (i.e. the products are manufactured and designed to have a cycle life greater than any reasonably anticipated cycling in the field and, therefore, they very rarely, if ever, fail), the industry is continually looking for ways to increase the cycle life of such springs. Cycle life means the number of times that a spring may be alternately deformed and released before failure.

Customers continue to look for improved cycle life and may often make purchasing decisions based on improved cycle life. This is true even though prior device cycle life greatly exceeds anticipated cycling experienced in the field. Therefore, improvements in cycle life are of significant economic consequence.

It is an object of the present invention to provide a switching coax jack having an improved switch assembly to dramatically enhance the cycle life of springs within the jack.

II. SUMMARY OF THE INVENTION

According to a preferred embodiment of the present invention, a switching coax jack is provided having a jack housing containing first and second spaced apart conductors. At least one port is formed in the jack housing and sized to receive a jack plug which is inserted through the port. The plug engages the first conductor in electrical communication. The jack housing contains a switch assembly for electrically connecting the first and second conductors when a plug is absent from the port and for breaking the electrical connection upon insertion of a plug. The switch assembly includes a normal spring having a first portion biased into releasable electrical contact with the first conductor and a second portion in electrical contact with the second conductor. Means are provided for urging the first portion away from the first conductor in response to insertion of a plug into the port. The switch assembly also includes a retaining mechanism for retaining a central portion of the normal spring at a fixed location. The normal spring is resiliently deformable in response to a force placed on the normal spring urging it away from the first conductor. As the normal spring deforms, it assumes a predetermined shape. The switch assembly further includes a support surface opposing the normal spring as it is deformed. The support surface is shaped to be complementary to the predetermined deformed shape of the normal spring.

III. BRIEF DESCRIPTION OF THE DRAWINGS

IV. DESCRIPTION OF THE PREFERRED EMBODIMENT

Figure 1:
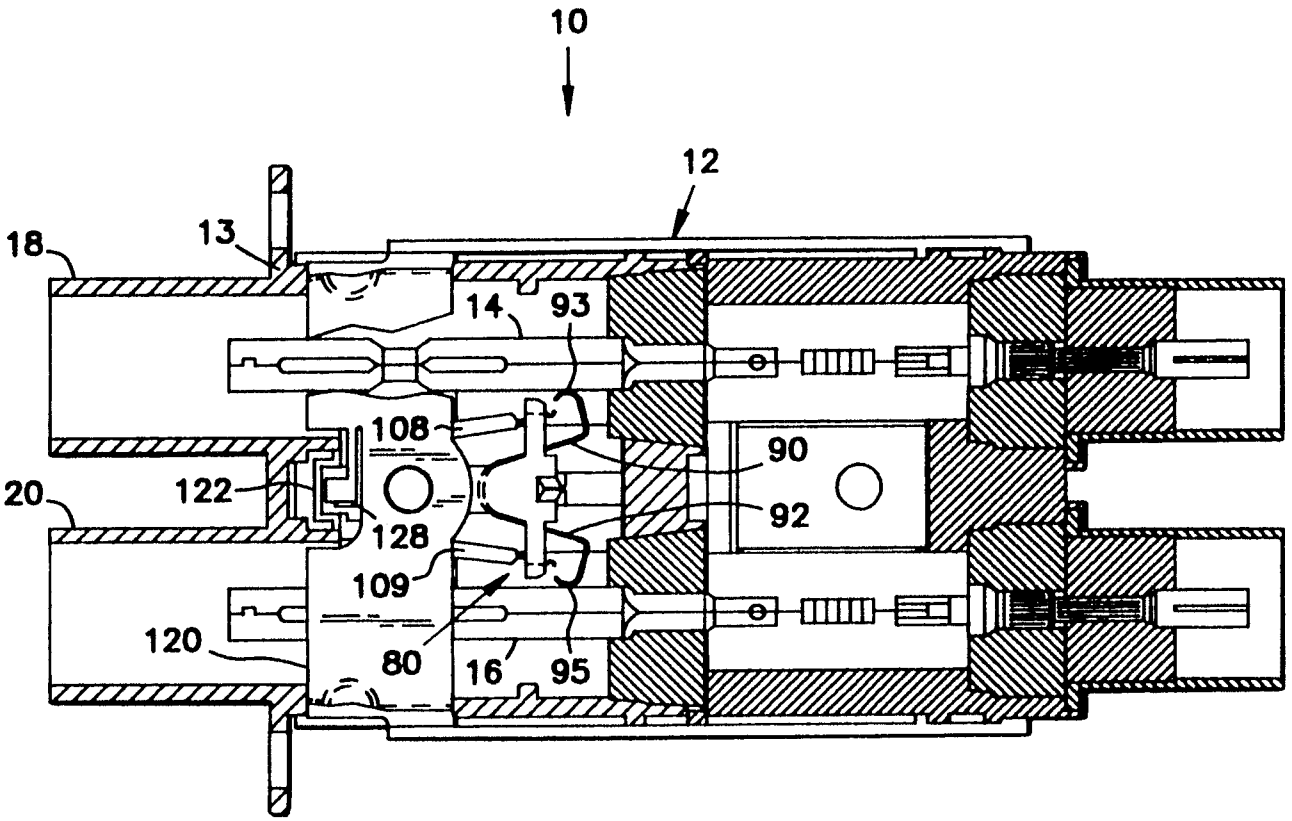
FIG. 1 is a top plan view of a switching coax jack according to the present invention with a portion of the jack housing removed to show the interior elements of the jack.

Referring initially to FIG. 1, a switching coax jack 10 according to the present invention is shown. The jack 10 includes a housing 12. Disposed within the interior of housing 12 are a first electrical conductor 14 and a second electrical conductor 16. The forward end 13 of the housing 12 contains a first port 18 and a second port 20. Ports 18 and 20 are sized to receive a jack plug (not shown) of predetermined dimensions. The ports 18 and 20 are disposed for a plug to electrically engage conductors 14,16 respectively, upon insertion into ports 18,20.

The embodiment shown in FIG. 1 has dual ports on the forward end 13. Alternatively, only a single port (such as port 18) could be provided. As shown in the aforementioned U.S. Pat. No. 4,749,968, switching coax jacks having dual or single forward port configurations are well known.

A switch assembly 80 is provided for electrically connecting the first conductor 14 with the second conductor 16 when a plug is absent from either of ports 18,20. The switch assembly 80 is further selected such that the electrical connection is broken upon insertion of a plug into either of ports 18,20.

It will be appreciated that a coax jack having an internal switch assembly is no part of this invention per se. Such a jack is the subject of U.S. Pat. No. 4,749,968. The present invention is directed to an improvement in the jack assembly 80.

Figure 2:
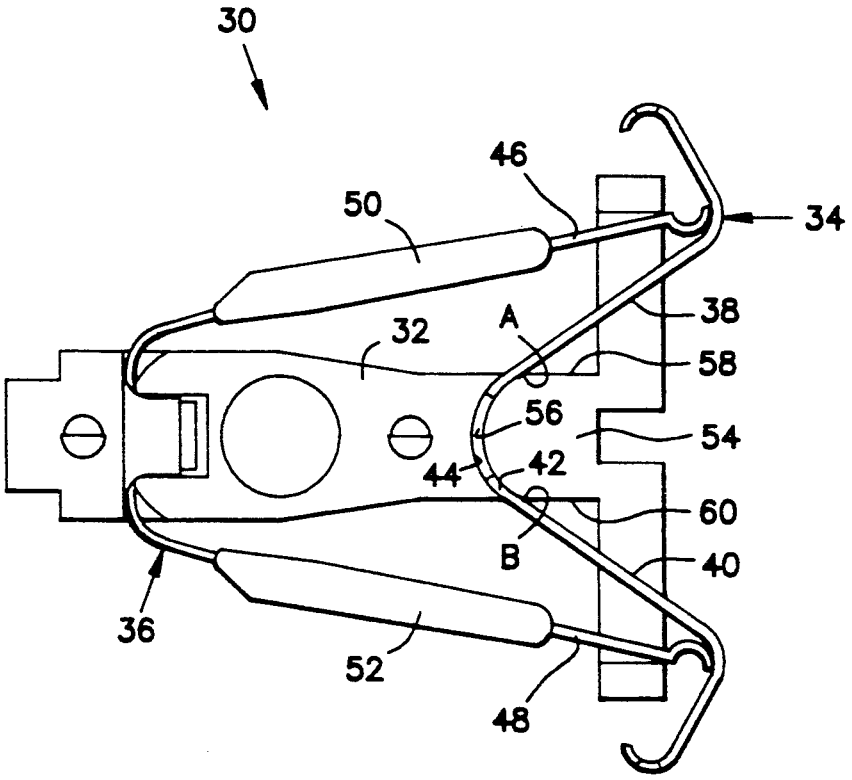
FIG. 2 is a top plan view of a prior art switch assembly.

Before proceeding with a detailed description of jack assembly 80, a description of a prior art jack assembly will be given to facilitate an understanding and appreciation for the present invention. With best reference to FIG. 2, a prior art switch assembly 30 is shown. Switch assembly 30 includes a switch assembly housing 32, a normal spring 34 and a termination spring 36.

Normal spring 34 is generally V-shaped in configuration and includes a first portion 38 biased toward a first conductor (not shown) and a second portion 40 biased toward a second conductor (not shown). An arcuate central portion 42 is disposed within an arcuate slot 44 in switch housing 32 to retain the normal spring 34 in the switch housing 32.

The termination spring 36 is generally U-shaped and includes a first arm 46 opposing first portion 38 and a second arm 48 opposing second portion 40. Each of first and second arms 46,48 are provided with dielectric contact pads 50,52 which are engaged by a plug inserted within the jack to urge the arms 46,48 against first and second portions 38,40 to thereby urge the first portions 38,40 against their natural bias away from the internal conductors of the jack.

The switch housing 32 includes a support post 54 which has a semi-circular surface 56 which opposes central portion 42 of normal spring 34. At the ends of the semi-circular portion 56, the support post 54 extends in flat surfaces 58 and 60 which are tangent to the semi-circular portion 56.

We have determined that the structure thus described produces localized stress points in the spring 34 as it is deformed by either of first or second arms 46,48. For example, as portions 38,40 are deflected toward support post 54, localized stress occurs in portions 38,40. The localized stress is positioned at locations A and B which are located near or closely adjacent to the intersection of the flat surfaces 58,60 with the semi-circular surface 56. The localized stress locations A,B are attributable to the location of a fixed fulcrum point at these locations as the switch spring 34 is deflected. During very high repeated cycling of the switch springs about the fixed fulcrum points A and B (i.e., test cycling beyond industry standards), the spring can fail due to breakage or plastic deformation of the spring at the localized stress points A and B.

Having described the prior art switch assembly 30, attention is now directed to FIGS. 3–8 which show a switch assembly 80 according to the present invention.

Figure 4:
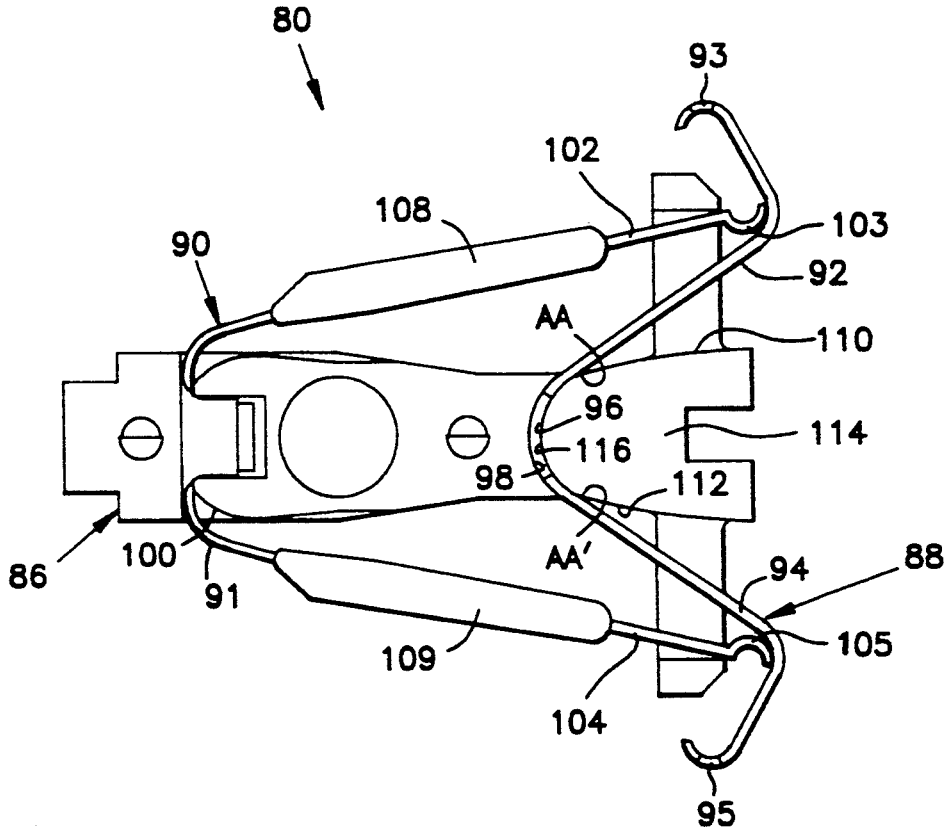
FIG. 4 is a top plan view of a portion of the switch assembly of FIG. 3 showing a normal spring in an undeflected position.

Switch assembly 80 includes a housing 82 having an upper half 84 and a lower half 86 formed of dielectric material. For ease of illustration, only lower half 86 is shown in FIG. 4 and only a normal spring and support post are shown in FIGS. 5–8. The housing 82 contains a generally V-shaped normal spring 88 and a generally U-shaped termination spring 90.

Shown best in FIGS. 4–8, normal spring 88 includes a first portion 92 and a second portion 94 joined by an arcuate central portion 96. Arcuate central portion 96 is retained in a fixed location in housing 82 by arcuate portion 96 being retained in a generally semi-circular slot 98 formed in lower switch housing half 86 adjacent a support post 114. First and second portions 92,94 terminate at contact ends 93,95.

Termination spring 90 has its central portion 91 received within a slot 100 formed in housing half 86. A first arm 102 extends from portion 91 and terminates at a contact end 103 opposing first portion 92. A second arm 104 extends from central portion 91 and terminates at a contact end 105 opposing second portion 94. The contacts 103,105 are first and second predetermined locations against which forces are applied on first and second portions 92,94 to urge the normal spring 88 to deform as will be described.

First and second arms 102,104 are provided with contact pads 108,109 of dielectric material. Contact pads 108,109 are engaged by a plug inserted within either of ports 18,20. In FIG. 4, normal spring 88 is shown in a relaxed position with no force being applied at the contacts 103,105. When assembled into a completed switching jack 10, as shown in FIG. 1, the spring 88 is partially deflected with arms 92,94 urged toward one another as shown in FIG. 1. This deflection is necessary for the resilient bias of the spring 88 to be utilized to insure a good electrical contact between contact ends 93,95 and conductors 14,16.

Figure 5:
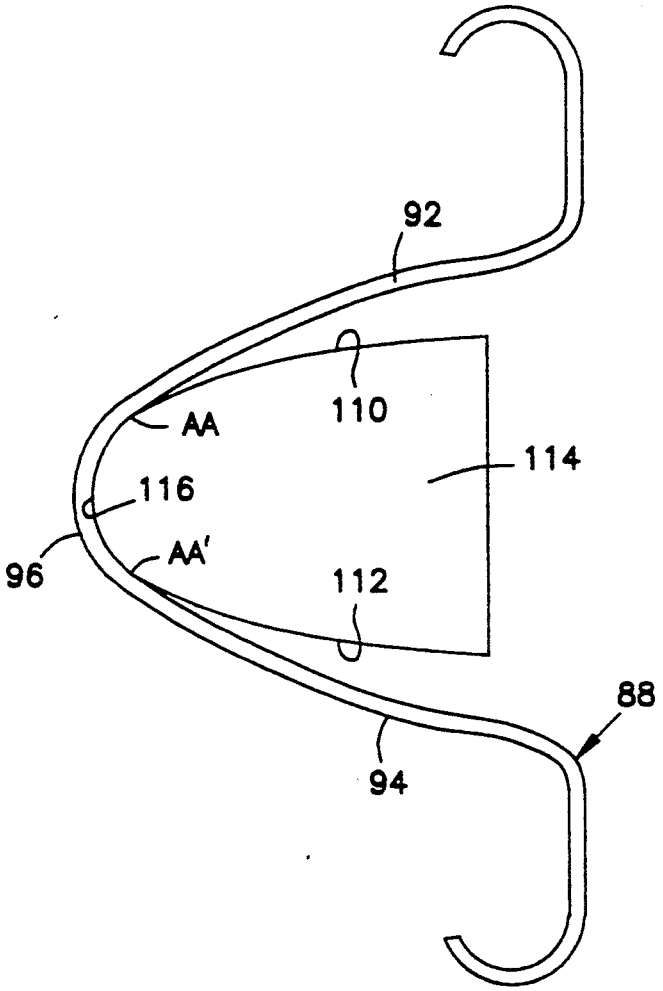
FIGS. 5–8 are top plan views of a normal spring surrounding a support post with the spring shown in various states of compression from mild deflection (FIG. 5) through fully deflected (FIG. 8).
Figure 6:
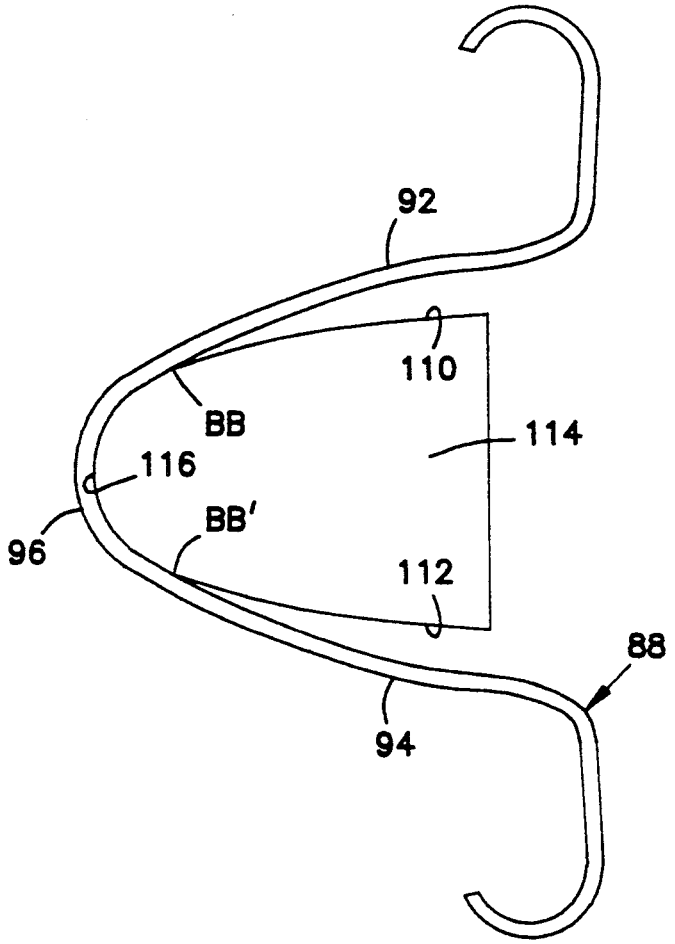
Figure 7:
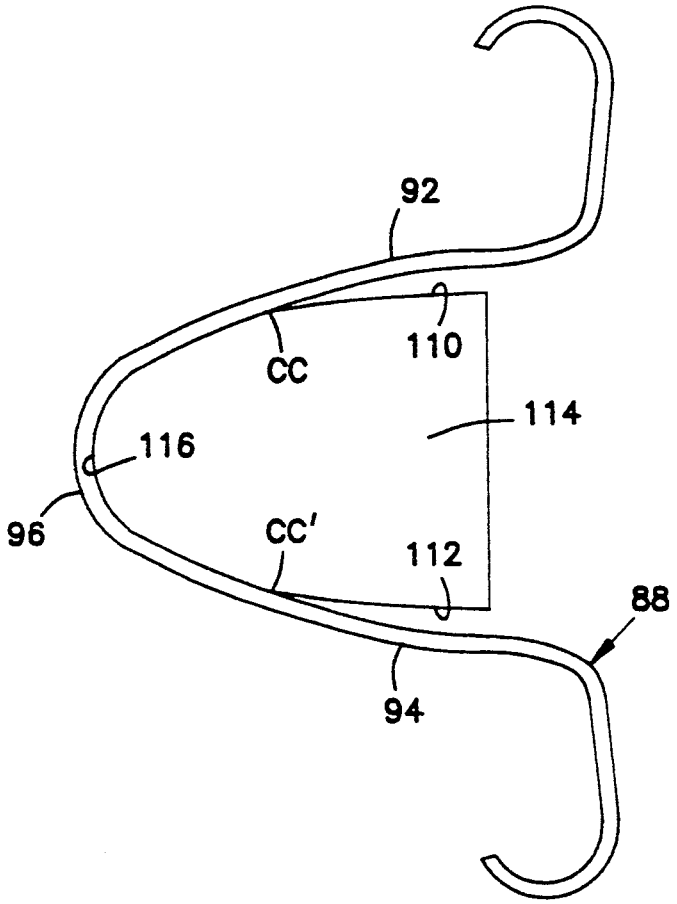
Figure 8:
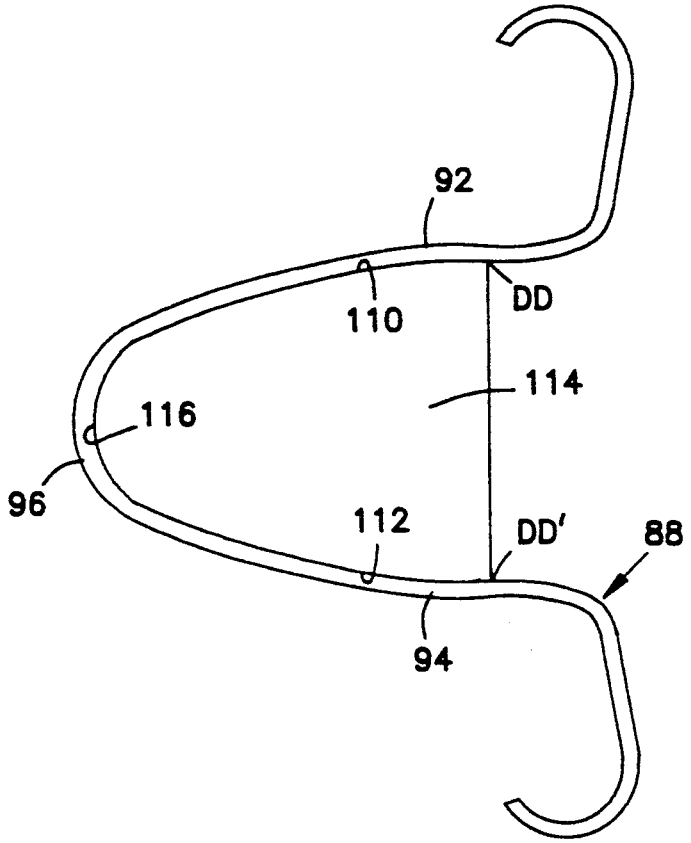

FIG. 5 shows a portion of the view of FIG. 1 with the spring 88 partially deflected against a support post 114 by an amount equal to the deflection of the spring between conductors 14,16 (i.e., the amount of deflection shown in FIG. 1). FIG. 6 shows the shape of spring 88 with portions 92,94 deflected toward post 114 in response to a plug (not shown) partially inserted into ports 18,20. FIG. 7 shows the shape of the spring 88 deflected further toward post 114 in response to further insertion of a plug. FIG. 8 shows the shape of spring 88 with portions 92,94 fully deflected toward post 114 in response to a plug being fully inserted into ports 18,20.

Through empirical observation, the shape of arms 92,94 when spring 88 is fully compressed (as shown in FIG. 8) is determinable. Having predetermined the shape of the resiliently deformed normal spring 88, the support surfaces or support ramps 110,112 of support post 114 are shaped.

With best reference to FIGS 5–8, it is noted that support post 114 has a generally semi-circular surface 116 opposing central portion 96. Support surfaces 110,112 are generally parabolic and are shaped to be complementary to and conform with the predetermined arcuate surface of arms 92,94 which have been fully deflected in response to urging forces by contacts 103,105. The surfaces 110,112 are positioned to abut arms 92,94 when they are so deformed.

As a result of shaping surfaces 110,112 to be complementary to the deformed shape of arms 92,94, the disadvantages associated with a fixed fulcrum point are eliminated. Instead, the fulcrum point experienced by the bending or deformation of arms 92,94 is constantly moving along the length of arms 92,94. The length of surfaces 110,112 are selected so that they terminate at termination ends 111,113 spaced beyond the contacts 103,105. Conveniently referred to as a "moving fulcrum" point, this phenomena results in a distribution of stress along the length of arms 92,94 rather than having the stress being localized as was the case in prior art switch assembly designs.

With reference to FIGS. 5–8, the fulcrum point of portions 92,94 moves from locations AA,AA' to locations BB,BB' as the portions 92,94 are deformed from FIG. 5 to FIG. 6. From FIG. 6 to FIG. 7, the fulcrums move from BB,BB' to locations CC,CC'. Finally, as the portions 92,94 are deformed to the position of FIG. 8, the fulcrums move from location CC,CC' to location DD,DD'.

By distributing the stress over the length of the arms 92,94, we project that the cycle life of the normal spring 88 may be tripled (or better). This greatly enhances the projected reliability of the jack 10 and the module of which it is a part.

In FIGS. 5–8, surfaces 110, 112 are generally parabolic. However, this shape may vary depending on the normal spring. The surfaces 110, 112 are selected to complement the shape of any deflected normal spring. This shape is preferably selected from empirical observations of a fully deflected normal spring so that a fulcrum or stress point on the normal spring is constantly moving along the length of the spring as the spring is being deformed.

In addition to greatly enhancing the life of the spring 88, the switch assembly 80 of the present invention includes means for incorporating electrical elements in a more desirable manner.

As disclosed in the aforesaid U.S. Pat. No. 4,749,968 termination springs such as spring 90 are connected across a resistance to ground. The present invention incorporates a novel technique for accomplishing that function.

Figure 3:
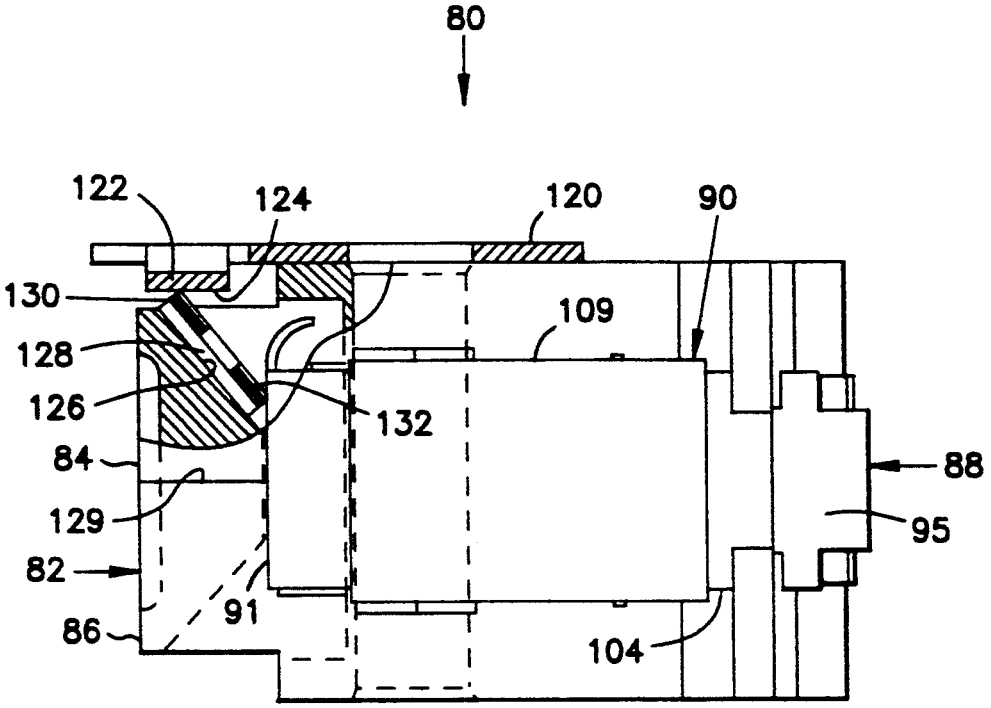
FIG. 3 is a side elevation view, shown partially in section, of a switch assembly according to the present invention.

Shown best in FIG. 3, the central portion 91 of the termination spring is generally flat and, in the view of FIG. 3, is vertically oriented. A grounding clip 120 is shown connected to the dielectric housing 82. The grounding clip 120 includes a cantilevered grounding contact 122 (shown in FIGS. 1 and 3). The grounding contact 122 has a contact surface 124 which is generally perpendicular to the plane of portion 91. Disposed between surface 124 and portion 91 is a ramp 126 formed on a surface of top housing half 84. Preferably, ramp 126 is positioned at about 50° to the parting line 129 between the upper and lower housing halves 84,86.

A chip resistor 128 of known surface mount technology is provided having contact pads 130,132 disposed on edges of the chip resistor 128. Edge pad 130 opposes surface 124 and edge pad 132 opposes surface 91. The resilient cantilevered contact 122 urges chip resistor 128 against portion 91 such that sound electrical contact is made between surfaces 124,91 and pads 130, 132 respectively upon attachment of the grounding clip 126 to the housing 82.

The foregoing description has identified shaping of the surfaces 110, 112 by empirically identifying the shape of a stressed spring. A similar and alternative method is to utilize computer aided finite element analysis. It will be appreciated that finite element analysis is an analysis technique known in the art. By using this technique, Applicants can design a geometry for a support surface to minimize a spring's stress.

Utilizing finite element analysis, a spring is modeled. A support surface 110 of specific shape is inputted into the model and the molded spring is displaced a prescribed distance. (Initially, the inputted shape is the shape obtained through the foregoing description—i.e., the observed shape of a deformed spring.) With the computer aided finite element analysis, stresses on the spring are noted. A different surface shape is inputted and the stress distribution on the spring in response to the new surface is noted. Multiple iterations of this technique are employed to identify the shape of the surface which results in minimum localized stress on the spring (i.e. the stress resulting from the displacement of the spring is spread as evenly as possible over the spring). By using this technique, Applicants have found that the shape of the support surface 110 is substantially similar to the shape employed using the technique previously described (for example, Applicants have noted that the deviation between the support surface shapes in the two techniques is about 0.003 inches at its widest location). As a result, the finite element technique is used in cooperation with the foregoing described technique to refine the shape of the support surface.

Having described the present invention with reference to a preferred embodiment, those skilled in the art will appreciate the many modifications and variations to which the preferred embodiment may be made while retaining the concepts of the invention. Accordingly, it is intended not to limit the scope of the protection of the present application to the preferred embodiment but to include such modifications and equivalents.

What is claimed is:

1. A switch coax jack comprising:

a jack housing;

first and second spaced apart electrical signal conducting means disposed within said housing;

at least a first port formed in said jack housing and sized to receive a jack plug to be inserted through said port and into said housing with said plug in electrical communication with said first electrical signal conducting means;

a switch assembly for electrically connecting said first and second conducting means when a plug is absent from said first port and for breaking electrical connection between said first and second conducting means when the plug is inserted into said first port;

said switch assembly including a normal spring of electrically material with said normal spring having a first portion biased into releasable electrical contact with said first conducting means and a second portion in electrical contact with said second conducting means;

said switch assembly further including urging means for urging said first portion away from said first conducting means in response to an insertion of a plug into said first port with said urging means applying an urging force on said first portion at a first predetermined location;

said switch assembly including means for retaining said normal spring in said jack housing with said normal spring having a portion held in a fixed location;

said normal spring first portion resiliently deformable from said fixed location to said predetermined location in response to said urging force, said first portion presenting a spring surface of predetermined shape as said first portion is deformed in response to an urging force in an absence of restraints opposing said first portion assuming said predetermined shape; and said switch assembly including a support surface opposing said first portion as said first portion is deformed, said support surface selected to be complementary to said predetermined shape and positioned to oppose and abut said spring surface as said spring surface is urged to said predetermined shape with said support surface positioned to complementarily mate with said spring surface in said predetermined shape.

2. A jack according to claim 1 wherein said first support surface is generally parabolic.

3. A jack according to claim 1 wherein said first support surface extends at least to said first predetermined location.

4. A jack according to claim 1 wherein said predetermined shape is empirically determined and said support surface is formed to complementarily mate with said first portion spring surface when said spring surface is deformed to said predetermined shape.

5. A jack according to claim 1 comprising at least a second port formed in said jack housing and sized to receive a jack plug through said port and into said housing with said plug in electrical communication with said second electrical signal conducting means;

said normal spring's second portion being resiliently biased into electrical contact with said second conducting means;

said switch assembly urging means including means for urging said second portion away from said second conducting means in response to an insertion of a plug into said second port by applying an urging force on said second portion at a second predetermined location;

said normal spring second portion being resiliently deformable from said fixed location to said second predetermined location in response to said urging force, said second portion presenting a surface of predetermined shape as said second portion is deformed;

said switch assembly including a second support surface opposing said second portion as said second portion is deformed, said second support surface selected to be complimentary to said second predetermined shape.

6. A jack according to claim 5 wherein said second support surface is positioned to abut said second portion.

7. A jack according to claim 5 wherein said second support surface is generally parabolic.

8. A jack according to claim 5 wherein said second support surface extends at least to said second predetermined location.

9. A switching coax jack comprising: a jack housing; first and second spaced apart electrical signal conducting means disposed within said housing;

at least a first port formed in said jack housing and sized to receive a jack plug to be inserted through said port and into said housing with said plug in electrical communication with said first electrical signal conducting means;

a switch assembly for electrically connecting said first and second conducting means when a plug is absent from said first port and for breaking electrical connection between said first and second conducting means when the plug is inserted into said first port;

said switch assembly including a normal spring of electrically conductive material with said normal spring having a first portion biased into releasable electrical contact with said first conducting means and a second portion in electrical contact with said second conducting means;

said switch assembly further including urging means for urging said first portion away from said first conducting means in response to an insertion of a plug into said first port with said urging means applying an urging force on said first portion at a first predetermined location;

said switch assembly including means for retaining said normal spring in said jack housing with said normal spring having a portion held in a fixed location;

said normal spring first portion resiliently deformable from said fixed location to said predetermined location in response to said urging force; and said switch assembly including a support surface opposing said first portion as said first portion is deformed, said support surface having a generally non-circular radius of curvature and selected for said first portion to experience minimized localized stress as said first portion is urged against said support surface.

10. A method for constructing a switching coax jack having a jack housing; first and second spaced apart electrical signal conducting means disposed within said housing; at least a first port formed in said jack housing and sized to receive a jack plug to be inserted through said port and into said housing with said plug in electrical communication with said first electrical signal conducting means; a switch assembly for electrically connecting said first and second conducting means when a plug is absent from said first port and for breaking electrical connection between said first and second conducting means when the plug is inserted into said first port; said switch assembly including a normal spring of electrically conductive material with said normal spring having a first portion biased into releasable electrical contact with said first conducting means and a second portion in electrical contact with said second conducting means; said switch assembly further including urging means for urging said first portion away from said first conducting means in response to an insertion of a plug into said first port with said urging means applying an urging force on said first portion at a first predetermined location; said switch assembly including means for retaining said normal spring in said jack housing with said normal spring having a portion held in a fixed location; said normal spring first portion resiliently deformable from said fixed location to said predetermined location in response to said urging force; said switch assembly including a support surface opposing said first portion as said first portion is deformed; said method comprising:

modeling said normal spring first portion and selecting a support surface shape to minimize stress on said modeled first portion as said modeled first portion is displaced.

11. A method according to claim 10 wherein said modeling is performed using finite element analysis.

* * * * *

UNITED STATES PATENT AND TRADEMARK OFFICE

CERTIFICATE OF CORRECTION

PATENT NO. : 5,147,992

DATED : September 15, 1992

INVENTOR(S) : Byron Eriksen, et al.

It is certified that error appears in the above-identified patent and that said Letters Patent is hereby corrected as shown below:

Column 6, line 5, "126" should read --120--;

Column 6, claim 1, line 64, insert --conductive-- after the word "electrically".

Signed and Sealed this

Fourth Day of January, 1994

*Attest:*

*Attesting Officer*

BRUCE LEHMAN

*Commissioner of Patents and Trademarks*